US007546692B2

(12) United States Patent
Simko

(10) Patent No.: US 7,546,692 B2
(45) Date of Patent: Jun. 16, 2009

(54) SIDING HANGER AND METHOD OF HANGING SIDING

(76) Inventor: Timothy A Simko, 1720 Hinckley Hills Rd., Hinckley, OH (US) 44233

( * ) Notice: Subject to any disclaimer, the term of this patent is extended or adjusted under 35 U.S.C. 154(b) by 30 days.

(21) Appl. No.: 11/829,545

(22) Filed: Jul. 27, 2007

(65) Prior Publication Data

US 2008/0106021 A1 May 8, 2008

Related U.S. Application Data

(60) Provisional application No. 60/864,684, filed on Nov. 7, 2006.

(51) Int. Cl.
*G01B 5/25* (2006.01)

(52) U.S. Cl. ..... 33/647; 33/613

(58) Field of Classification Search ..... 33/613, 33/645, 646, 647, 648, 649; 52/547, 548, 52/748.1

See application file for complete search history.

(56) References Cited

U.S. PATENT DOCUMENTS

| | | | | | |
|---|---|---|---|---|---|
| 198,772 | A | * | 1/1878 | Marsh | 33/646 |
| 325,811 | A | | 9/1885 | Benson et al. | |
| 332,323 | A | * | 12/1885 | Brand | 33/646 |
| 1,115,202 | A | * | 10/1914 | Ingles | 33/646 |
| 2,519,656 | A | | 8/1950 | Howe | |
| 2,889,632 | A | * | 6/1959 | Longhi | 33/648 |
| 3,463,480 | A | | 8/1969 | Edstrom | |
| 3,490,152 | A | | 1/1970 | Printz | |
| 3,792,852 | A | | 2/1974 | Reniker | |
| 3,904,184 | A | | 9/1975 | Krueger et al. | |
| 4,089,141 | A | | 5/1978 | Heroux | |
| 4,155,175 | A | * | 5/1979 | Stiles | 33/646 |
| 4,159,029 | A | | 6/1979 | Matthews | |
| 4,164,346 | A | | 8/1979 | Sickler | |
| 4,314,429 | A | | 2/1982 | Casteel et al. | |
| 4,600,183 | A | | 7/1986 | Ogden | |
| 4,899,459 | A | | 2/1990 | Taggart | |
| 5,290,019 | A | | 3/1994 | Beyers | |
| 5,465,499 | A | | 11/1995 | LaPlante | |
| 5,692,311 | A | * | 12/1997 | Paquin | 33/647 |
| 5,884,447 | A | | 3/1999 | Earp | |
| 6,640,512 | B1 | | 11/2003 | Kinnaman et al. | |
| 6,684,521 | B2 | | 2/2004 | Rempe | |
| 6,820,868 | B1 | | 11/2004 | Reymus | |
| 6,871,846 | B2 | | 3/2005 | Antill | |
| 7,124,551 | B1 | | 10/2006 | Patera | |
| 7,134,253 | B2 | | 11/2006 | Edwards et al. | |
| 7,207,122 | B1 | | 4/2007 | Ellis | |
| 2006/0070311 | A1 | | 4/2006 | Shilling | |

OTHER PUBLICATIONS

International Search Report, dated Mar. 22, 2008.

* cited by examiner

*Primary Examiner*—G. Bradley Bennett
(74) *Attorney, Agent, or Firm*—Pearne & Gordon LLP

(57) ABSTRACT

Provided is a hanger for installing a workpiece on a structure, and the method of installing the workpiece using the hanger. At least one embodiment of the hanger includes a first part adapted for removably attaching the hanger to a structure; a second part adapted for supporting a second workpiece in position for installation on the structure; and a third part adapted for properly spacing the second workpiece in relation to a previously positioned first workpiece that is already installed on the structure, wherein the third part is adapted to be moveable in relation to the second part.

32 Claims, 5 Drawing Sheets

SIDING HANGER AND METHOD OF HANGING SIDING

CROSS-REFERENCE TO RELATED APPLICATIONS

Benefit of U.S. Provisional Patent Application Ser. No. 60/864,684, filed on Nov. 7, 2006, is hereby claimed and the disclosure incorporated herein by reference.

BACKGROUND OF THE INVENTION

1. Field of the Invention

This application relates generally to a device to aid the installation of a workpiece on a structure, and the method of installing the workpiece using the device.

More specifically, this application relates to a siding hanger for hanging concrete or similar siding on a building structure, and the method of hanging concrete or similar siding using the hanger.

2. Background

Conventional approaches for hanging concrete siding on a building during installation rely on manual labor for holding the siding in place during the installation process. However, such methods can be difficult to practice due to the heavy nature of such siding, which can quickly stress the individual (s) holding the siding in place. These methods are also typically labor intensive, requiring a sufficient number of workers to both hold the siding in place and to properly fasten the siding to the structure.

Some devices have been developed that can support the installation process. However, such devices have shown a number of shortcomings, such as a lack of reusability and/or removablity, lack of utility, and operating in a manner that does not maximize worker productivity and maintain high quality work.

Needed is a device and method for hanging siding that overcomes one or more of these problems and/or additional problems.

BRIEF SUMMARY OF THE INVENTION

Provided are a plurality of embodiments the invention, including, but not limited to: a hanger comprising first part adapted for removably attaching the hanger to a structure; a second part adapted for supporting a second workpiece in position for installation on the structure; and a third part adapted for properly spacing the second workpiece in relation to a previously positioned first workpiece that is already installed on the structure, wherein the third part is adapted to be moveable in relation to the second part.

Provided is hanger comprising a first part adapted for removably attaching the hanger to a structure; a second part adapted for supporting a second workpiece in position for installation on the structure; and a third part adapted for properly spacing the second workpiece in relation to a previously positioned first workpiece that is already installed on the structure, wherein the first part includes a portion adapted for being positioned between the second workpiece and the structure during installation of the second workpiece.

Provided is hanger comprising a first part adapted for removably attaching the hanger to a structure; a second part adapted for supporting a second workpiece in position for installation on the structure; and a third part adapted for properly spacing the second workpiece in relation to a previously positioned first workpiece that is already installed on the structure, wherein the first part includes a portion adapted for being positioned between the second workpiece and the structure during installation of the second workpiece, wherein the third part is adapted to be moveable in relation to one or both of the first part and the second part.

Also provided is workpiece hanger comprising: a first part forming a hole for removably attaching the hanger to a structure using a fastener; a second part connected to the first part and forming a saddle for supporting a second workpiece in position for installation on the structure; a third part adapted for properly spacing the workpiece in relation to a previously positioned first workpiece that is already installed on the structure, wherein the third part has a lip for contacting an edge of the first workpiece and a handle; and a hinge for connecting the third part to the second part, wherein the hanger is adapted such that: the lip of the third part contacts the edge of the first workpiece when the third part is placed in a first position, and the second part is adapted to hold at least a portion of the weight of the second workpiece during installation of the second workpiece when the third part is placed in a second position; and wherein the handle is used for removing the hanger after the first part has been unattached to the structure.

Further provided is a method of attaching a workpiece to a structure, the method comprising the steps of:

installing a first workpiece on the structure;

using the first workpiece for positioning a hanger at a proper location on the structure when the hanger is in a first configuration for contacting the first workpiece;

attaching the hanger to the structure;

placing the hanger in a second configuration;

placing a second workpiece in the hanger, wherein the hanger holds at least a portion of the weight of the second workpiece and wherein the hanger holds the second workpiece in a proper position for installation;

at least partially installing the second workpiece; and detaching the hanger from the structure, wherein the hanger can be reused.

BRIEF DESCRIPTION OF THE DRAWINGS

The features and advantages of the examples of the present invention described herein will become apparent to those skilled in the art to which the present invention relates upon reading the following description, with reference to the accompanying drawings, in which.

DETAILED DESCRIPTION OF THE EXAMPLE EMBODIMENTS

Various embodiments of a device that is a tool for properly positioning and supporting a workpiece for installation are discussed, as are methods utilizing the tool for installing the workpiece.

For example, a tool for installing boards of siding, such as wooden boards, plastic boards, cement boards, and concrete siding, for example, are discussed herein. Also discussed are methods of installing such siding utilizing such a tool.

The tool, such as one of the hangers disclosed herein, would typically be attached to a structure and a piece of siding is positioned to be held in place by the tool (e.g., the "siding hanger" or the "hanger" of the disclosed embodiments). One or more of the tools support the piece of siding being installed, which allows an installer to secure the siding to the structure without having to simultaneously support the siding himself (and/or without requiring additional workers to support the siding). Thus, one person could, in many instances, install the siding by himself, whereas previously a plurality of persons might be necessary to install the siding. After the piece of siding is secured to the structure, the tool(s) are unattached from the structure and slid out from under the piece of siding. The tool(s) can then be reused to position and secure another piece of siding.

In use, the siding hangers disclosed herein are embodiments of such a tool. Such a siding hanger is typically attached (e.g., nailed or screwed) to a framing member of the structure, such as a 2×4 stud, for example. Alternatively, the siding hanger is attached to sheathing, such as plywood or oriented strand board sheathing, for example, that will likely be a part of the structure, or at least temporarily attached thereto. Additional means of securing the siding hanger to the structure could also be utilized, if desirable (e.g., Velcro, removable glues, hooks, etc.).

First Example Embodiments

Figure 1:
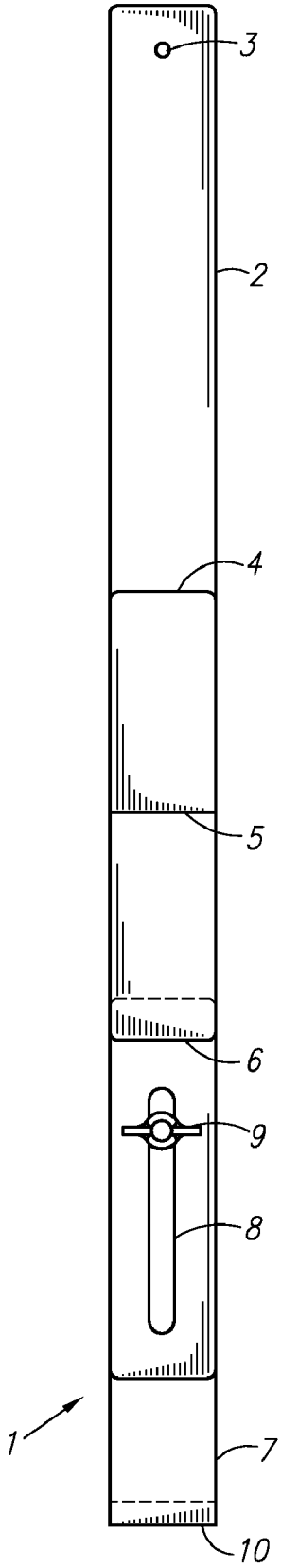
FIG. 1 is a front elevation view of a first example embodiment of a siding hanger.
Figure 2:
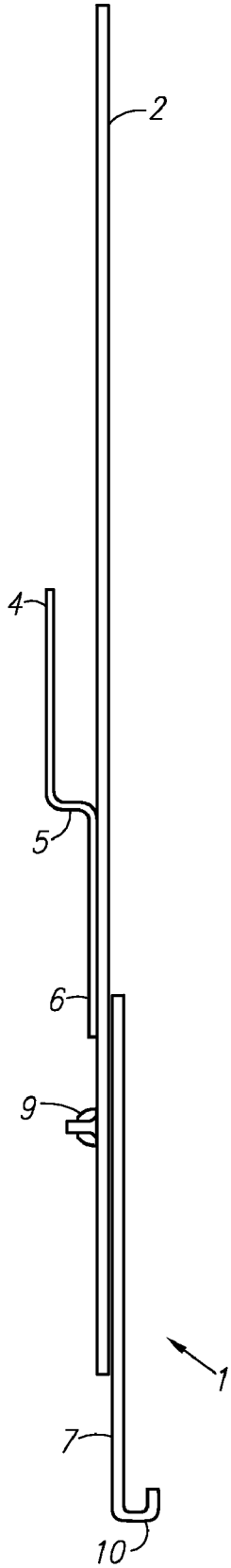
FIG. 2 is a side elevation view of the siding hanger of FIG. 1.
Figure 3:
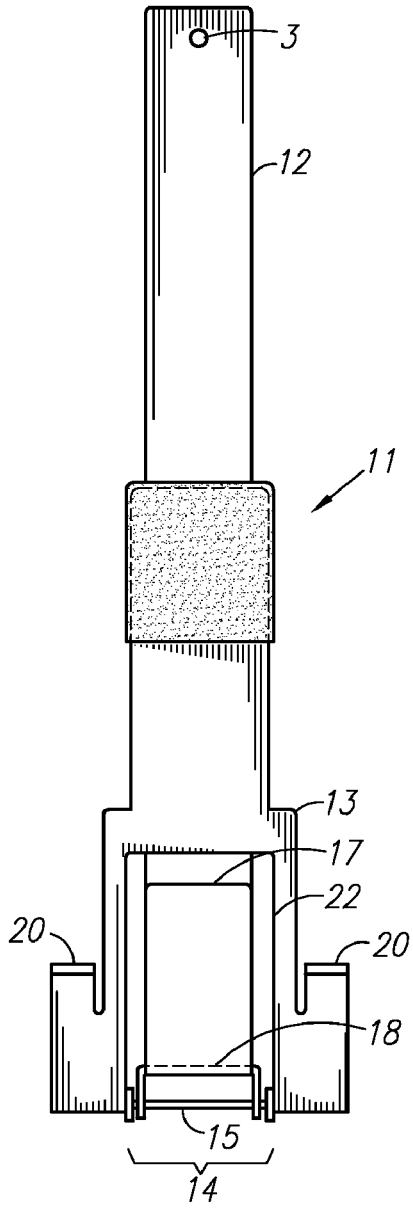
FIG. 3 is a front elevation view of a second example embodiment of a siding hanger in a folded position.
Figure 4:
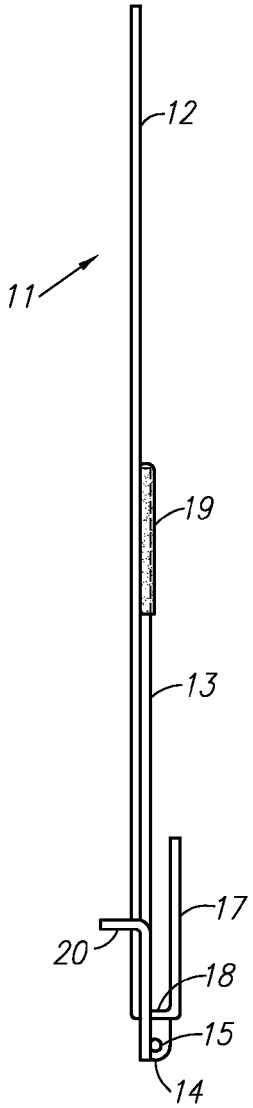
FIG. 4 is a side elevation view of the siding hanger of FIG. 3 in the folded position.

A first example embodiment of a siding hanger 1 is provided as shown in FIGS. 1 and 2. The siding hanger 1 includes a body bracket 2 that is made from a material such as steel or some other metal, or a strong plastic, for example. The body bracket 2 forms a hole 3 for attaching the siding hanger 1 to a structure. A fastener (not shown), such as a nail or screw, for example, is inserted through the hole 3 and secured to the structure, for example, secured to a framing member or sheathing. The fastener supports the siding hanger 1 and attaches the siding hanger to the structure. The fastener is removable and is to be removed after the siding piece is installed, so that the siding hanger 1 can be reused. For example, if a nail is used, it would be preferable to leave a portion of the nail raised from the structure to ease its removal. As another example, a screw may not be fully tightened and instead might be only partially inserted into the structure to ease its removal.

The body bracket 2 includes a keeper 4 forming a saddle 5. A piece of siding (not shown) is placed into the keeper 4 and onto the saddle 5. The keeper 4 and saddle 5 hold the piece of siding in place, so that the piece of siding can then be secured to the structure by the installer.

The keeper 4 can be made of one piece, such as being formed by bending one piece of steel to form the saddle 5 and having a portion 6 of the keeper 4 being attached to the body bracket 1, such as by welding, brazing, or soldering, for example. Other means of attaching the keeper 4 include gluing, spot welding, or using a fastener such as a screw or rivet, for example. Furthermore, the keeper 4 might be of some other material rather than steel, such as a different metal, or a plastic material, for example. Furthermore, the saddle 5 could be of a separate piece and/or different material from the bracket 1 and/or keeper 5, or all three may be of a single integrated piece of material. The keeper 4 may be of the same material as the body bracket 2, or a different material.

An adjustment bracket 7 can be provided to properly position the siding hanger 1 during use to accommodate various widths of siding and provide the desired reveal/overlap between adjacent pieces a siding. The adjustment bracket 7 can be, for example, adjustably attached to the body bracket 2 using a slot 8 and fastener 9. In FIG. 1, the body bracket 2 forms a slot 8, and the adjustment bracket 7 is moveable along the slot 8. The adjustment bracket 7 is secured in a desired position along the slot 8 via the fastener 9. Accordingly, the adjustment bracket 7 is vertically moveable along a portion of the body bracket 2. It is to be appreciated that a corresponding adjustment bracket 7 slot (not shown), i.e., a slot formed in the adjustment bracket 7, could alternatively or additionally be provided for vertical movement of the body bracket 2 along the adjustment bracket 7. The adjustment bracket 7 can be made from similar materials as the body bracket 2, or different materials, and may be of the same material as the body bracket, or of a different material.

The adjustment bracket 7 would typically have a lip portion 10 (such as a bend) provided so that the siding hanger 1 can be mounted against a previously installed piece of siding, by being placed under the bottom edge of the previously installed piece. The lip portion 10 may be, for example, J-shaped as shown, or could be "L" shaped (by removing or flattening the extra hook portion of the J), or some other useable shape. The extension of the adjustment bracket 7 beyond a lower edge of the body bracket 2 is adjustable, as discussed above, by sliding the adjustment bracket 7 along the body bracket 2. The adjustment of the adjustment bracket's extension sets the desired reveal and overlap for the siding installation. Once adjusted, the position of the adjustment bracket 7 is secured in place, such as by the fastener 9. Typically, this same adjustment would be used for the entire installation job, but it could be modified, if desired, such as to change the overlap/reveal or to adjust for different widths siding.

The fastener 9 can be, for example, a threaded stud, pressed in place with a wing nut (as shown), or some other type of fastener that can be loosened and tightened to adjust the position of the adjustment bracket 7 relative to the body bracket 2. Other types of adjustments might also be used, such as magnetically based, or using some other form of mechanical adjustment.

A method of using the siding hanger 1 to install siding will now be described. The hanger would first be adjusted for the proper reveal and overlap by loosening the fastener 9, and then adjusting the adjustment bracket 7. The fastener 9 would then be tightened after the correct measurement for the reveal and overlap has been established. The siding hanger 1 would thereby be set for the chosen type of siding and desired reveal/overlap, and would not typically need to be re-adjusted unless those parameters have changed. A plurality of additional hangers could then be adjusted in the same manner based on the adjustment of the originally adjusted hanger.

The adjustment bracket lip 10 of the hanger being positioned would then be held against the bottom of a previously installed piece of siding. (If there is no previously installed piece, the siding hanger 1 could be used for the initial installation by placing the saddle 5 at the desired location for the bottom edge of the siding to install the initial piece of siding at the bottom row; if the adjustment bracket 7 gets in the way, it could be removed for this first installation step, if desired.) Typically, it is desirable that the siding form a series of overlapping rows installed from bottom to top. The adjustment bracket lip 10 is held against the bottom of a piece of siding of the uppermost already installed row. A fastener, such as nail or screw, for example, would then be installed through the hole 3, and secured to the structure (by nailing or screwing, for the respective examples). The fastener thereby secures the siding hanger 1 in a proper position relative to the uppermost row of previously installed siding. Additional sliding hangers could be installed in a similar manner, as desired, to support the piece of siding by spacing them along the horizontal length of the siding. Typically, at least two sliding hangers would be utilized, although additional hangers could also be used, if desired, or a single hanger might suffice in some circumstances. For heaving siding pieces, two or more hangers would likely be recommended, and for siding that might bow under its own weight, more than two might be useful, especially for long pieces.

A piece of siding would then be placed inside of the keeper 4 and onto the saddle 5 of the one or more hangers. The keeper 4 would thereby hold the siding in place so that the installer is free to secure the siding to the structure without having to support the weight of the siding himself. The reveal and overlap of the previously installed row of siding by the currently installed piece would thus be correct, due to the prior adjustment of the adjustment bracket 7.

Two siding hangers at a minimum would likely be used to hang a piece of siding, especially if the siding is heavy, such as in concrete siding or dense boards. The two hangers would be spaced apart a desired distance to balance the siding. The siding could then be secured, such as by either the blind or face nailing method, for example, after the siding is in the correct position. The siding might be completely secured while being held by the hanger, or else only partially secured, with the securing being completed after removal of the hanger. Only partial securing might be desirable to ease the removal of the hangers.

After the siding is secured to the structure, the fastener that secures the siding hanger(s) 1 to the structure would be removed from the hole 3. This would free the siding hanger 1 for its removal from behind of a piece of newly installed siding. The newly installed siding would hold the siding hanger 1 in place by the tension against the structure. To remove the siding hanger 1, one would hold the bottom of the siding hanger 1, for example, at the lip 10, and then pull the siding hanger 1 down and out from behind of the newly installed piece of siding. The siding hanger 1 would exit the overlap of the siding on the angle, thus eliminating any contact with the previous piece of siding. The lack of contact would be accomplished by the angle of the installed siding. The hanger would rest against the bottom edge of the siding and the structure behind the hanger. The structure would force the siding hanger 1 to be removed on an angle. The siding hanger 1 may also be removed by sliding it sideways and past an end of the newly installed piece of siding, if there are no intervening nails or screws blocking the hanger 1. Unless the siding is too heavy for a single person to maneuver, a single worker could perform the entire process in most cases.

The first example embodiment requires an adjustment step during initial installation to set the reveal and overlap of the siding. The second example embodiment discussed below can be used to eliminate the need for any such adjustment step, as the units can be designed for a specific application.

Second Example Embodiments

A second example embodiment of a device (tool) for hanging siding is a siding hanger 11, as shown in FIGS. 3-12. The siding hanger 11 can be made from a material such as steel, aluminum, or some other metal, or a strong plastic or composite material, for example. It may be painted, galvanized, alloyed, or otherwise treated to prevent rusting or other corrosion, if the base material is so prone. Combinations of such materials may also be used for the various components.

The siding hanger 11 of FIGS. 3-12 comprises a hanger strap 12 and a swing lap gauge 13. The hanger strap 12 and swing lap gauge 13 are joined at a hinge 14. The swing lap gauge 13 can be rotated toward and away from the hanger strap 12 via the hinge 14. The hinged connection between the hanger strap 12 and swing lap gauge 13 allows the siding hanger 11 to assume a folded position as shown in FIGS. 3, 4, 7, and 8, and an unfolded position as shown in FIGS. 5, 6, and 9-12. The hinge 14 can be designed in any of a number of ways to provide the hinged connection. The example embodiment comprises a pin 15, such as a hardened steel pin, for example, for attaching the hanger strap 12 to the swing lap gauge 13. The pin 15 is inserted through holes in corresponding hinge portions of the hanger strap 12 and swing lap gauge 13.

In this example embodiment, the hanger strap 12 forms a hole 3 for attaching the siding hanger 11 to a structure. A fastener 16 (see FIGS. 7, 9, and 11), such as a nail or screw, for example, can be inserted through the hole 3 and secured to the structure, for example, secured to a framing member or sheathing by nailing or screwing, respectively. Other means of fastening the hanger could also be used, as also discussed above.

As discussed above with respect to the first example embodiment, the fastener 16 supports the siding hanger 11 and removably attaches the siding hanger 11 to the structure. The fastener 16 is removable (e.g., by pulling the nail or unscrewing the screw, respectively), and is typically to be removed after the siding piece is installed, so that the siding hanger 11 can be reused. Thus, the hanger would typically not become a permanent part of the structure.

Figure 5:
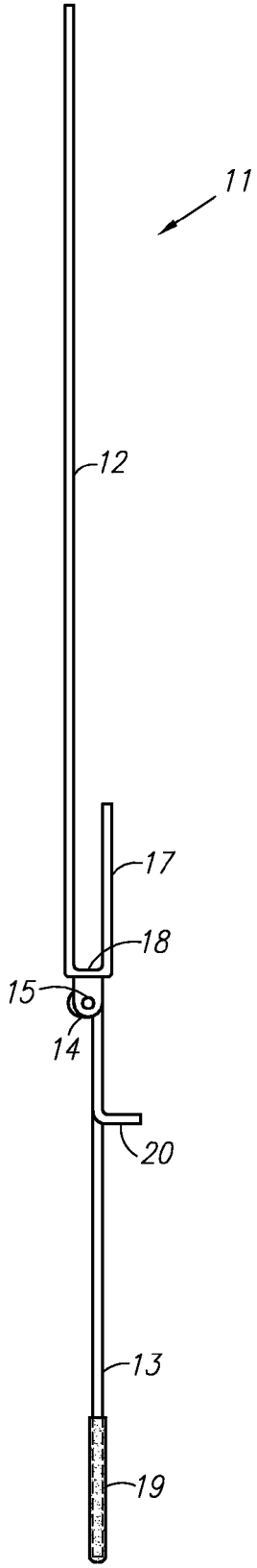
FIG. 5 is a side elevation view of the siding hanger of FIGS. 3-4 in the unfolded position.
Figure 6:
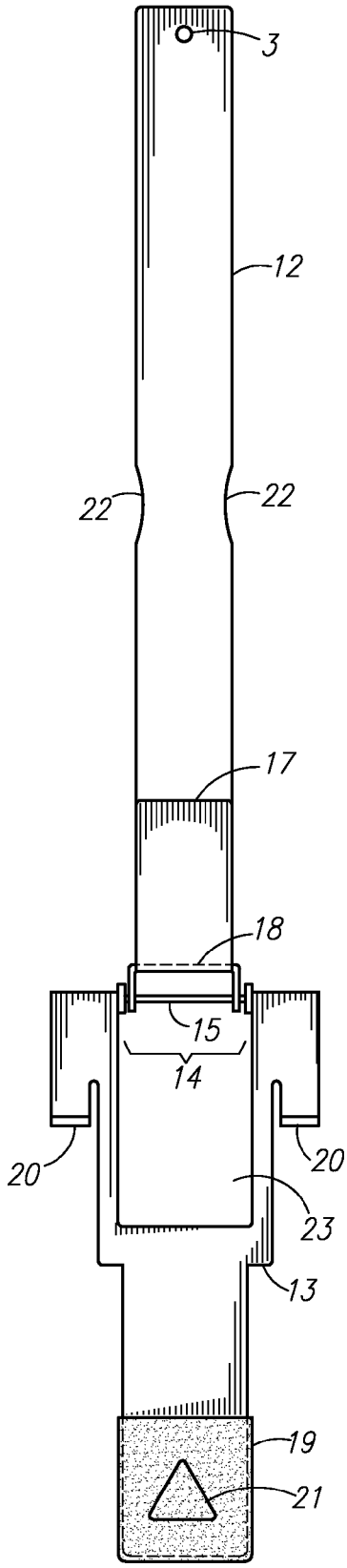
FIG. 6 is a front elevation view of the siding hanger of FIGS. 3-5 in the unfolded position.

The hanger strap 12 includes a keeper 17 and saddle 18 for supporting a piece of siding during installation of that piece of siding. The hanger strap 12 can be formed by bending a piece of metal into an "J" shape, as seen in FIG. 5 (as a reverse "J"), for example, to form the keeper 17 and saddle 18. As similarly discussed above with respect to the first embodiments, in this example embodiment the keeper 17 and saddle 18 support a piece of siding when the hanger strap 12 is used during installation of the siding.

The swing lap gauge 13 comprises a handle portion 19 and a pair of lips 20 that form a double "L" shape (one of which can be seen in the view of FIG. 5). The handle portion 19 can be grasped (such as by hand) to rotate the swing lap gauge 13 and to pull the siding hanger 11 downward and then out from behind of a piece of installed siding for removal after the fastener has been released. The handle portion can optionally include a coating, such a example thermoplastic coating (e.g., plastisol dip coating) as shown, to provide a grip and help protect the finish of previously installed siding when the swing lap gauge 13 is rotated to the unfolded position (thus possibly having the handle portion 19 contact a previously installed piece of siding).

An optional holding component 21 can be provided on the handle portion 19, for temporarily holding the swing lap gauge 13 to the hanger strap 12 when the siding hanger 11 is in the folded position, to avoid its dropping down on its own. The holding component 21 can comprise a bracket, clamp, magnet, clip, or some other attachment. The example embodiment shown in the figures uses a triangular magnet as the holding component 21 for use when the hanger strap 12 of the hanger 11 is comprised at least partially of a magnetic material, such as steel, for example.

Figure 7:
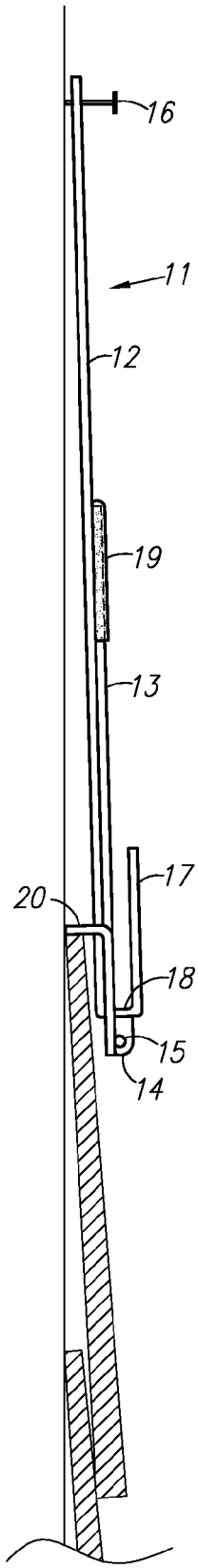
FIG. 7 is a side elevation view of the siding hanger of FIGS. 3-6 in the folded position and mounted to a structure and contacting previously installed siding.
Figure 8:
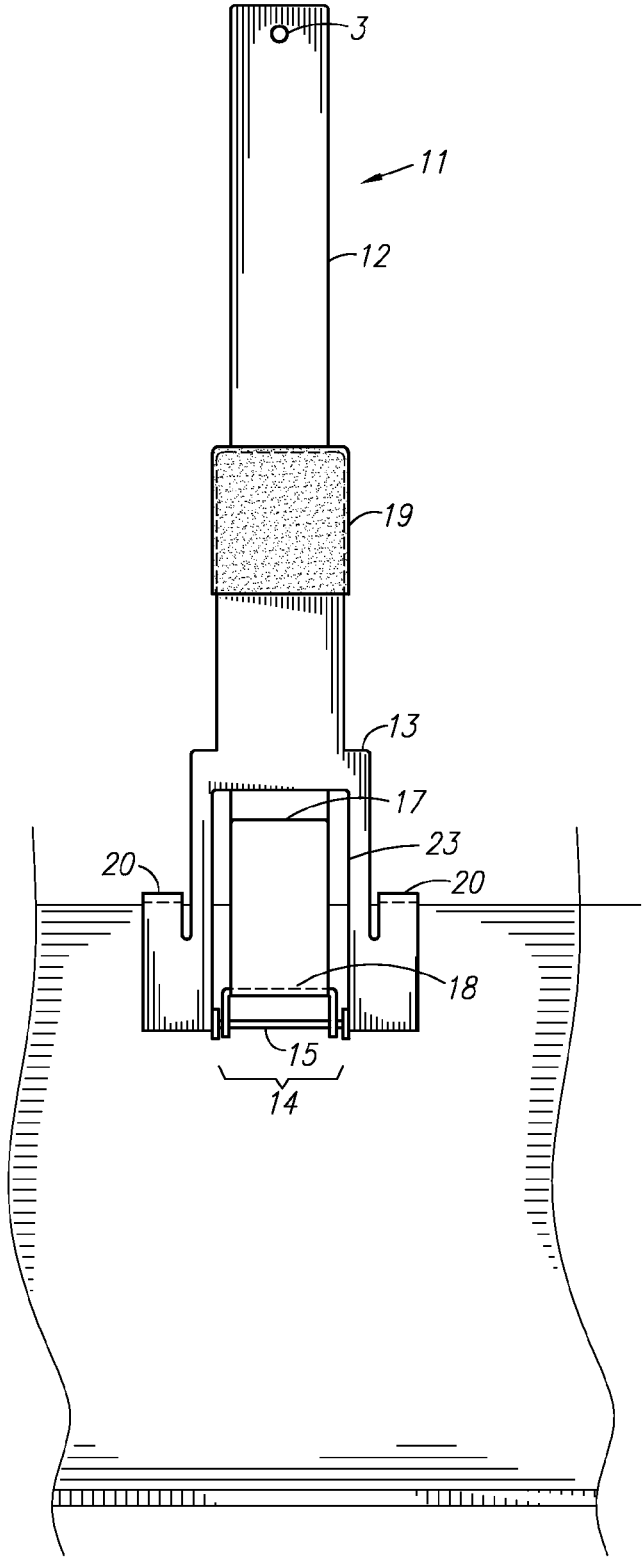
FIG. 8 is a front elevation view of the siding hanger as in FIG. 7 in the folded position and mounted to the structure having the previously installed siding.

The lips 20 of the swing lap gauge 13 are adapted to rest on a previously installed piece of siding when the siding hanger 11 is in the folded position, which can be seen in the illustrations of FIGS. 7 and 8. The lips 20 properly position the hanger strap 12, keeper 17 and saddle 18 relative to the previously installed siding, so that a piece of siding to be inserted into the keeper 17 properly overlaps the previously installed siding. Accordingly, the swing lap gauge 13 provides a desired fixed siding overlap and reveal, such as a ½ inch overlap, ¾ inch overlap, 1 inch overlap, 1¼ inch overlap, 1½ inch overlap, 1¾ inch overlap, or a 2 inch overlap, as examples. It is to be appreciated that the swing lap gauge 13 could be adapted to provide overlaps of other dimensions as well, or no overlap at all.

In these particular embodiments, the overlap is designed into the dimensions of the swing lap gauge 13. Thus, to support various different overlaps/reveals and/or different widths of siding, the swing lap gauge 13 can be made readily removable from the hanger strap 12 and replaceable with another swing lap gauge 13, to provide a different desired overlap and reveal. Accordingly, various adaptations of the siding hanger 11 can be provided to support various siding installations. An adjustable version more like the first embodiment could also be provided, if desired.

The swing lap gauge 13 forms a gauge opening 23 via a cutout in the material of the swing lap gauge 13. The gauge opening 23 allows the swing lap gauge 13 to be moved past the keeper 17 of the hanger strap 12 as the swing lap gauge 13 is moved between the folded and unfolded positions. The hanger strap 12 of the example embodiment includes concave recesses 22 that are located behind the handle portion 19 of the swing lap gauge 13 when the swing lap gauge 13 is in the folded position. The concave recesses 22 aid an installer in grasping the handle portion 19 when the swing lap gauge 13 is to be moved from the folded position. Of course, these recesses could be eliminated if desired. When folded, the holding component 21 helps to hold the swing lap gauge 13 in the folded position, as discussed above.

A method of using the siding hanger 11 to install siding will now be described, with reference to FIGS. 7-12. The siding hanger 11 would first be placed into the folded position by rotating the swing lap gauge 13 upward and to the hanger strap 12, where the holding component 21, if provided, will hold it in a folded position. The siding hanger 11 is then placed against a structure so that the lips 20 rest on top of a previously installed row of siding, as shown in FIGS. 7 and 8. (If there is no previously installed piece of siding, the method of installing starter strips, described below, can be used. Alternatively, the siding hanger 11 could be used for the initial installation by placing the saddle 18 of the folded siding hanger 11 at the desired location at the bottom of the structure to be sided, and fixing the hanger to the structure in a manner similar to that discussed below, and then using one or more siding hangers 11 to support the initial piece of siding for installation.) A fastener 16 as described above is installed through the hole 3 and secured to the structure. For example, a nail is partially driven through the hole 3 and into a framing member or other portion of the structure (leaving enough of the nail head exposed to ease removal). The fastener 16 thereby secures the siding hanger 11 in a proper position relative to the uppermost row of previously installed siding.

Figure 9:
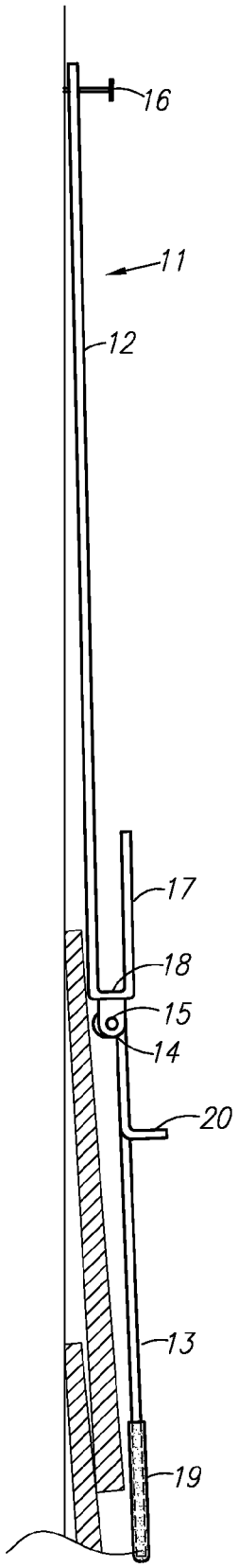
FIG. 9 is a side elevation view of the siding hanger of FIGS. 3-6 in the unfolded position and mounted to the structure having the previously installed siding.
Figure 10:
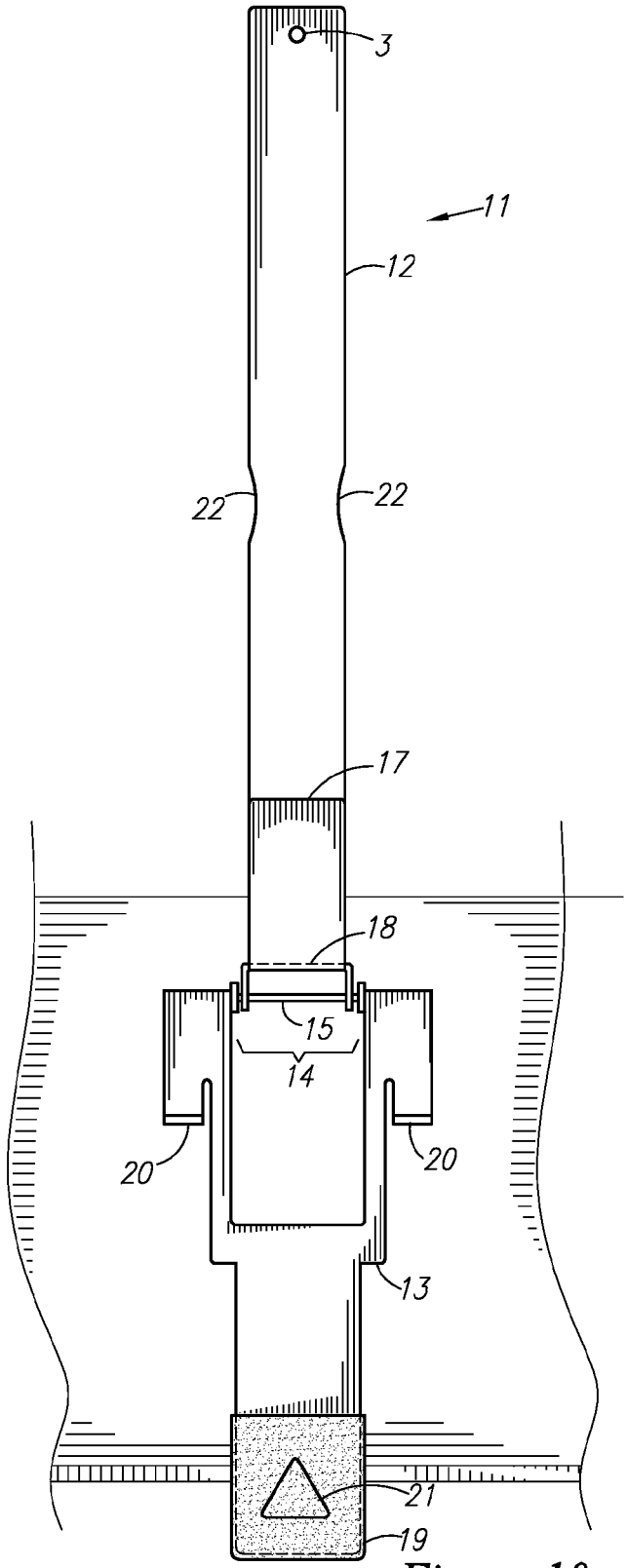
FIG. 10 is a is a front elevation view of the siding hanger as in FIG. 9 in the unfolded position and mounted to the structure having the previously installed siding.
Figure 11:
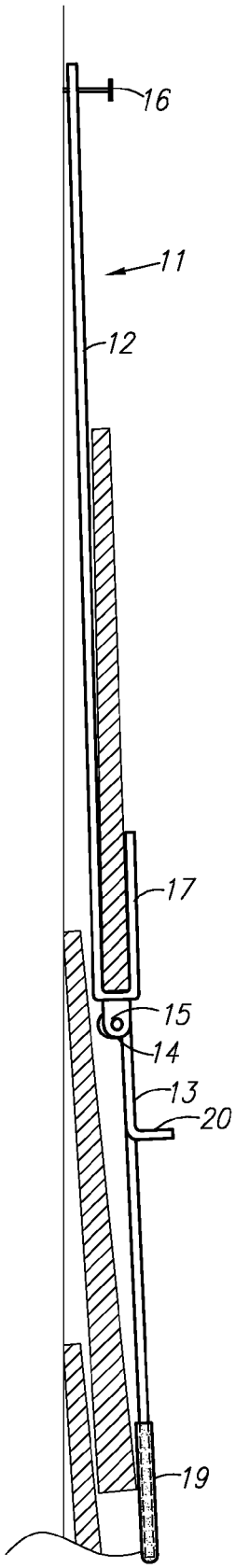
FIG. 11 is a side elevation view of the siding hanger of FIGS. 3-6 in the unfolded position, mounted to the structure and supporting a piece of siding to be installed.
Figure 12:
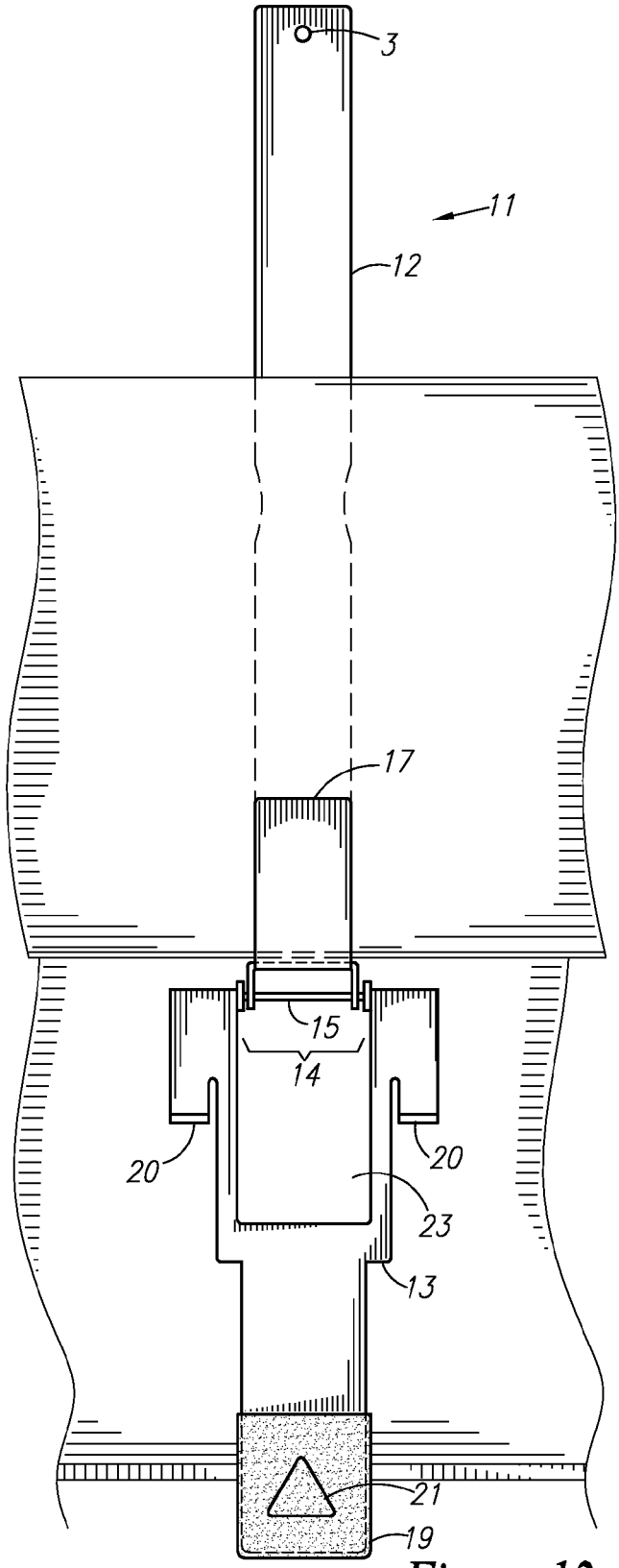
FIG. 12 is a front elevation view of the siding hanger of FIGS. 3-6 in the unfolded position, mounted to a structure and supporting the piece of siding to be installed.

With the siding hanger 11 secured in place via the fastener 16, the swing lap gauge 13 is moved from the folded position, as shown in FIGS. 7 and 8 to the unfolded position, as shown in FIGS. 9 and 10. The keeper 17 and saddle 18 of the hanger strap 12 have thus be positioned to overlap the previously installed siding by a fixed distance (as provided by the structure and dimensions of the swing lap gauge 13), which was set during the securing step by the positioning of the lips 20 of the swing lap gauge 13 during the fixing of the siding hanger 11 in the folded position (as discussed above). This would be repeated for any desired number of siding hangers needed to hold the siding in place. In most situations, at least two such hangers would probably be utilized, as discussed below, and they could be distributed horizontally along the length of the previously installed piece of siding, for example, or along the lengths of more than one previously installed piece of siding if the lengths of sequential rows are to be offset from previous and subsequent rows by some amount, as is often desirable.

A piece of siding is then placed inside of the keeper 17 and onto the saddle 18 of each siding hanger 11. The keepers of the hangers hold the siding in place, as shown in the example drawings of FIGS. 11 and 12, by supporting the weight of the siding and preventing the siding from falling way from the structure. The installer is free to secure the siding to the structure without having to support the weight of the siding himself. The reveal and overlap between the previously installed row of siding and the current installed piece would be correct as set by the lips 20 of the swing lap gauge 13 by the previous steps.

Two siding hangers 11 at a minimum would typically be used to hang a piece of siding. Additional siding hangers 11 could be utilized as desired. The hangers would be spaced apart a desired distance to properly balance and support the siding, and possibly to prevent bowing, if necessary. For installing heavier siding, such as siding using concrete or other dense materials, more than two hangers may be desired to safely support the siding. The siding could then be secured, such as by either the blind or face nailing method, for example, after the siding is in the correct position. The siding might be completely secured while being held by the hanger, or else only partially secured, with the securing being completed after removal of the hanger. Only partial securing might be desirable to ease the removal of the hangers.

After the siding is at least partially secured to the structure, the fastener 16 is removed from the hole 3 of the hangers to free the siding hangers 11. The installer then removes each one of the siding hangers 11 by grasping the handle portion 19 and pulling each hanger downward and out from between the installed pieces of siding, making the hangers available for further use. The siding hanger 11 may also be removed by sliding it sideways and past an end of the newly installed piece of siding, if there are no intervening nails or screws blocking the hanger 11. For some hanging methods, it may be possible that the newly fastened piece of siding may be swung out somewhat, especially at the lower end, to aid in removing the siding hanger, and in other cases, the upper portion might be swung out. Once the siding hanger is removed from the newly installed piece of siding, it can typically be reused to install additional pieces of siding, such as adjacent or atop the newly installed piece of siding, for example.

Conventionally, a minimum of two people were utilized to hang certain types of siding, such as cement board siding, and possibly a third person was utilized to fasten the siding. The weight of the siding would thus make this a continued and laborious task. Further, the siding could be dropped and broken during installation, increasing material costs and raising safety concerns. Also, a reference point or line would have to be established to line up the siding. Every row of siding has to be installed with the same overlap or the siding will "run out" or become crooked as it is installed. The disclosed siding hangers and methods allow for installation of heavy siding at a proper reveal or overlap by a single person, avoiding "run out" and reducing the required labor. Furthermore, unlike at least some other siding tools, the disclosed siding hangers can also be used to support the initial, lowermost row of siding.

For any of the embodiments, various types of fasteners can be utilized to fasten the hanger to toe structure. For example, steel studs, for example a screw such as a drywall screw, could be utilized. For CDX or OSB Board siding over 2×4's, a double headed #8 nail with the shank cut ¾" could be used. Any fastener should, in most instances, be installed a minimum ½" into surface. Typically, the hanger of the second example embodiment, when made of steel or steel alloys, can support a weight of about 150 pounds each using this method.

For foam board over framing, the fastener, depending on thickness of foam board, should penetrate, for example, a minimum of ½" into framing. Roofing nails can also be used. For most applications, the hanger does not necessarily have to be tight against the surface. Typically, the siding is fastened using either the blind or face nailing methods while being held in place by the hanger.

When the fastener is removed from the top of the hanger after fastening the piece of siding, tension from the siding will hold the hanger in place. Typically, the hanger is then grasped by the handle portion and pulled down and out from behind the siding. The handle is then folded up and reinstalled on the newly installed piece of siding, thus being made ready for installing the next piece of siding.

Additional Methods of Using the Hangers

The hangers described above can be used for supporting various additional construction processes.

For example, the hanger can be used to install starter strips. The process is to cut a piece of siding 1¼" wide from the stock being used. This strip is fragile and typically easy to break. The next step is to chalk a level line 1¼" up from where the bottom of the first piece of siding will be, and hand nail the starter strip on the chalk line. Even better, chalk a level line 12⅜ " up (distance between fasteners hole and saddle of hanger). Nail the hangers on the chalk line. Depending on the length of the starter strip, more than two hangers may be desirable. Fasten the starter strip, remove the fasteners, and remove hangers down and out (similar to the method described above). The hangers can be slanted to the sides, if the siding is close to the ground. Install the hanger on starter strip as in a manner similar to the installation of a piece of siding. Now, the first course of siding can be installed in the manner described above.

The hangers could also be used for making cut-outs for top & bottoms of windows, doors, or any other projection from a building. Because cut outs weaken siding, making it them easy to break, the hangers can be used to reduce the risk of damage. A method of making cut-outs for the bottom of a window is used as example.

Measure up from the previous piece of siding to the window sill, add 1¼" for overlap. Transfer this measurement to a piece of siding. This is the horizontal measurement. Add vertical or side measurements to the siding. This will be for the cut out. Plunge cut only the horizontal measurement in the back of the siding. The siding strength is not affected by this one cut. Place two hangers on each side of the window using #8 double headed nails, uncut, through the hangers ½" into the framing. Unfold the hangers and pull the hangers out on the nails, the distance of the window sill. Install the siding in the hangers. Now, make vertical cuts using a jig saw or shears. The siding can pivot from side to side in the hangers to avoid cutting the trim on the window. Push the hangers back on the nails and fit the cut around the window, once the cutout is complete. Secure the siding and remove the hangers. This method can be used for just about any cutout.

Furthermore, the hangers can be used to install siding against corner posts, trim, or butt seams. Once siding is placed in the hangers, the hangers will pivot back and forth to fit the siding against the trim or to butt against another piece.

Of course, additional uses of the hangers are also possible, providing additional utility and benefits.

The invention has been described hereinabove using specific examples and embodiments; however, it will be understood by those skilled in the art that various alternatives may be used and equivalents may be substituted for elements and/or steps described herein, without deviating from the scope of the invention. Modifications may be necessary to adapt the invention to a particular situation or to particular needs without departing from the scope of the invention. It is intended that the invention not be limited to the particular implementations and embodiments described herein, but that the claims be given their broadest interpretation to cover all embodiments, literal or equivalent, disclosed or not, covered thereby.

What is claimed is:

1. A workpiece hanger comprising:

a first part adapted for removably attaching said hanger to a structure;

a second part adapted for supporting a second workpiece in position for installation on the structure, wherein, said second part is further adapted to be positioned behind the second workpiece when the second workpiece is placed in position for installation; and a third part adapted for properly spacing the second workpiece in relation to a previously positioned first workpiece that is already installed on the structure, wherein said third part is adapted to be moveable in relation to said second part.

2. The hanger of claim 1, wherein said third part is adjustable for accommodating various widths of workpieces and for adjusting for a desired overlap between the first workpiece and the second workpiece when both are installed on the structure.

3. The hanger of claim 2, wherein said second part is fixedly attached to said first part and wherein said second part has a portion forming a saddle for receiving the second workpiece and wherein said third part has a portion for contacting a lower edge of the first workpiece and wherein said third part is adjustable by sliding said third part along said first part to adjust for said desired overlap and said various widths.

4. The hanger of claim 1, wherein said third part is attached to said second part via a hinge, and wherein said third part is adapted to be adjustable, using said hinge, by swinging said third part from a first position to a second position, said first position placing a portion of said third part into contact with an edge of the first workpiece for placing said hanger in a state for attaching said hanger to the structure in a manner providing a desired overlap between the first workpiece and the second workpiece, and said second position removing said portion of said third part from contact with the edge of the first workpiece for placing said hanger in another state for supporting the second workpiece during installation of the second workpiece.

5. The hanger of claim 4, wherein said second part is formed from a bend in said first part forming a saddle adapted for holding at least part of the weight of the second workpiece during installation of the second workpiece.

6. The hanger of claim 5, wherein said third part has a lip adapted for contacting the upper edge of the first workpiece when said third part is in said first position.

7. The hanger of claim 6, wherein said third part is adapted such that said lip is removed from contacting the upper edge of the first workpiece when said third part is in said second position.

8. The hanger of claim 7, wherein said hanger is adapted for being removed after installation of the second workpiece by detaching said first part from the structure and then manually pulling a handle portion provided on said third part for pulling said first part from under the second workpiece after installation.

9. The hanger of claim 8, further comprising a holding component for holding said third part in said first position until manually moved from said first position.

10. The hanger of claim 8, wherein said third part forms a gap for receiving said saddle when said third part is in said first position.

11. The hanger of claim 10, further comprising a holding component for holding said third part in said first position until said third part is manually moved from said position.

12. The hanger of claim 4, further comprising a holding component for holding said third part in said first position until said third part is manually moved from said position.

13. A workpiece hanger for aiding in the installation of workpieces on a base structure, said hanger comprising:

a first part adapted for removably attaching said hanger to a surface of the base structure;

a second part adapted for supporting a second workpiece in position for installation on the base structure, wherein, at least a portion of said second part is further adapted to be positioned behind said second workpiece when said second workpiece is placed in position for installation; and a third part adapted for properly spacing the second workpiece in relation to a previously positioned first workpiece that is already installed on the base structure, wherein said first part is further adapted for being positioned behind the second workpiece during installation of the second workpiece.

14. The hanger of claim 13, wherein said third part is adapted for having a first position for properly positioning said second workpiece on the base structure in relation to the first workpiece during attachment of said hanger to the base structure, and wherein said third part is adapted to have a second position for holding the second workpiece during installation of the second workpiece.

15. The hanger of claim 14, further comprising a holding component for holding said third piece in the first position until manually released.

16. The hanger of claim 14, wherein said second part includes a saddle for receiving the second workpiece when said third part is in said second position.

17. The hanger of claim 16, wherein said third part has a lip portion adapted for contacting the upper edge of the first workpiece when said third part is in the first position during attachment of said hanger.

18. The hanger of claim 17, wherein said third part forms a gap for receiving said saddle when said third part is in said first position.

19. The hanger of claim 13, wherein said third part has a lip portion adapted for contacting the upper edge of the first workpiece during attachment of said hanger.

20. A workpiece hanger comprising:

a first part forming a hole for removably attaching said hanger to a structure using a fastener;

a second part connected to said first part and forming a saddle for supporting a second workpiece in position for installation on the structure;

a third part adapted for properly spacing the workpiece in relation to a previously positioned first workpiece that is already installed on the structure, wherein said third part has a lip for contacting an edge of the first workpiece and a handle; and a hinge for connecting said third part to said second part, wherein said hanger is adapted such that:

said lip of said third part contacts the edge of the first workpiece when said third part is placed in a first position, and said second part is adapted to hold at least a portion of the weight of the second workpiece during installation of the second workpiece when said third part is placed in a second position;

and wherein said handle is used for removing said hanger after said first part has been unattached to the structure.

21. The hanger of claim 20, wherein said first part is comprised of a strip of material and wherein said second part is formed from a bend in said strip for forming said saddle.

22. The hanger of claim 21, wherein said lip is formed from a bend in the material forming said third part, and wherein said third part forms a gap for receiving said saddle when said third part is placed in said first position.

23. The hanger of claim 22, further comprising a holding component for holding said third piece in the first position until manually released.

24. The hanger of claim 22, said third part further comprising a second lip for contacting the edge of the first workpiece when said third part is placed in said first position.

25. The hanger of claim 21, further comprising a holding component for holding said third piece in the first position until manually released.

26. A method of attaching a workpiece to a structure, said method comprising the steps of:

installing a first workpiece on the structure;

using the first workpiece for positioning a hanger at a location on the structure when the hanger is in a first configuration having a part for contacting an edge of the first workpiece to establish the position of said hanger on the structure for setting a proper position for placing a second workpiece;

attaching the hanger to the structure;

placing the hanger in a second configuration for removing said part from contacting the edge of the first workpiece;

while the hanger is in the second configuration, placing the second workpiece in the hanger, wherein the hanger holds at least a portion of the weight of the second workpiece and wherein the hanger holds the second workpiece in the proper position for installation;

at least partially installing the second workpiece; and detaching the hanger from the structure, wherein the hanger can be reused.

27. The method of claim 26, wherein said step of installing the first workpiece on the structure also utilizes the hanger.

28. The method of claim 26, further comprising the step of working on the second workpiece to adapt the second workpiece to the structure prior to detaching the hanger from the structure.

29. The method of claim 26, further comprising the step of pulling the hanger from behind the second workpiece after said detaching step and prior to said reuse.

30. The method of claim 29, wherein the hanger comprises:

a first part adapted for removably attaching said hanger to the structure;

a second part adapted for supporting the second workpiece in position for installation on the structure, wherein, said second part is further adapted to be positioned behind said second workpiece when said second workpiece is placed in position for installation; and a third part that is the part for contacting an edge of the first workpiece adapted for properly spacing the second workpiece in relation to the previously positioned first workpiece that is already installed on the structure, wherein said first part is further adapted for being positioned behind the second workpiece during installation of the second workpiece.

31. The workpiece hanger of claim 1, wherein said second part is further adapted to be placed between one or both of the structure or the first workpiece when placed behind the second workpiece.

32. A workpiece hanger for installing siding panels on a base structure, said hanger comprising:

a hanger strap adapted for removably attaching said hanger to a surface of the base structure;

a keeper having a saddle and adapted for supporting a second siding panel in position for installation on the base structure, wherein said hanger strap is adapted to be positioned between the second siding panel and the base structure when the second siding panel is placed in position for installation; and a lap gauge having a lip and adapted for properly spacing the second siding panel in relation to a previously positioned first siding panel that is already installed on the base structure, wherein said lap gauge is adapted to be placed in a first position placing said lip in contact with an edge of the first siding panel to set the desired spacing, and also adapted to be placed a second position removing said lip from said contact with the edge of the first siding panel for placing said hanger in a state for installing said second siding panel.

* * * * *